US005857606A

United States Patent [19]

Tseng

[11] Patent Number: 5,857,606

[45] Date of Patent: Jan. 12, 1999

[54] ULTRAHIGH SPEED SUCTION GUN

[76] Inventor: Ching-Kun Tseng, 34 Lane 112, Hsi Yuan Road, Hsin Chun City 242, Taipei Hsien, Taiwan

[21] Appl. No.: 968,426

[22] Filed: Nov. 12, 1997

[51] Int. Cl.[6] ..... B65H 20/00

[52] U.S. Cl. ..... 226/97.4

[58] Field of Search ..... 226/97.4

[56] References Cited

U.S. PATENT DOCUMENTS

| | | | |
|---|---|---|---|
| 3,690,530 | 9/1972 | Porter | 226/97.4 |
| 3,970,231 | 7/1976 | Strutz et al. | 226/97.4 X |
| 4,181,247 | 1/1980 | McFall | 228/97.4 |
| 4,366,845 | 1/1983 | Simson | 226/97.4 X |
| 4,817,843 | 4/1989 | Sano | 226/97.4 |
| 5,326,009 | 7/1994 | Kobayashi et al. | 226/97.4 |

*Primary Examiner*—Michael Mansen

*Attorney, Agent, or Firm*—Dougherty & Troxell

[57] ABSTRACT

An ultrahigh speed suction gun which allows high pressure air introduced into it via a first rear end thereof to flow into a cyclone producer and an accelerator in the suction gun to produce accelerated cyclonic air flows while making a barrel of the suction gun vacuumized, so that a filament can be sucked into the suction gun via the barrel and be discharged from the suction gun via a second rear end thereof. The suction gun is characterized in that the cyclone producer and the accelerator can be conveniently mounted into and dismounted from the suction gun via a front opening thereof to facilitate repair and maintenance of the suction gun, and that the cyclone producer and the accelerator may either be provided at their rear ends with conic surfaces having a plurality of helical grooves or be provided at their respective stepped surfaces with several sets of computer simulated inclined through holes in different inclinations to generate even stronger accelerated cyclonic air flows to suck and guide the filament into and through the suction gun.

8 Claims, 11 Drawing Sheets

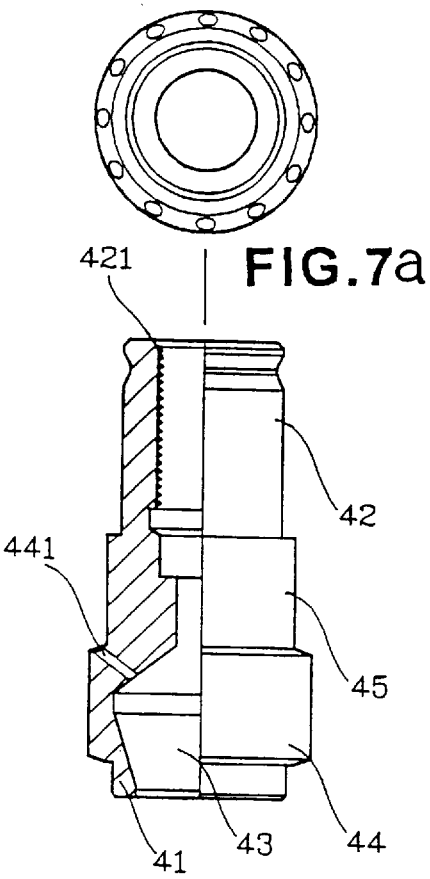
FIG.7a
FIG.7
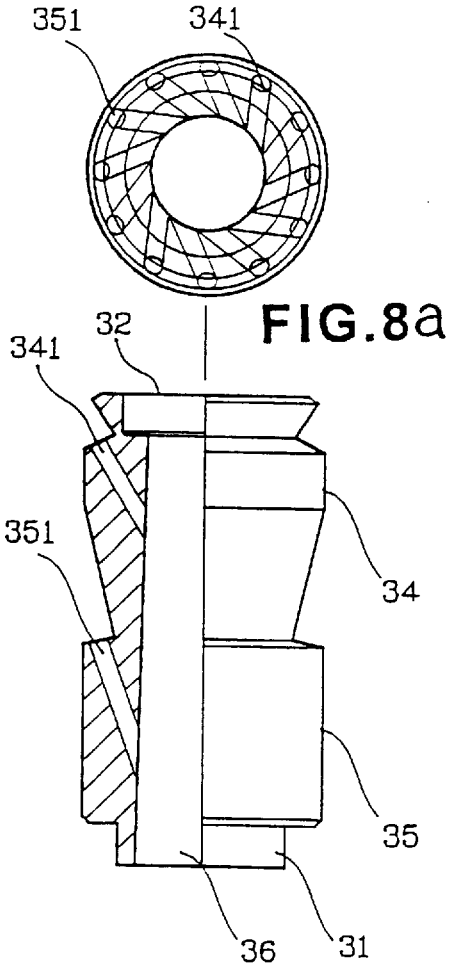
FIG.8a
FIG.8

ULTRAHIGH SPEED SUCTION GUN

BACKGROUND OF THE INVENTION

The present invention relates to an ultrahigh speed suction gun, and more particularly to a suction gun which is designed to have independent cyclone producer and accelerator to facilitate assembling and disassembling of the gun from a front end thereof for repair and maintenance purpose. The cyclone producer and the accelerator of the suction gun of the present invention is provided with a plurality of helical air guide ways or differently inclined through holes to produce even stronger and accelerated cyclone for the suction gun.

FIGS. 11 and 12 illustrate a conventional ultrahigh speed suction gun. With the suction gun, a filament initially blown at high speed and high temperature is sucked and guided to pass every guide rollers and is finally wound on a reel to start a production. The suction gun is a special but prerequisite tool in the filament production. The conventional suction gun includes an independent cyclone producer 94 and an accelerator 93 connected to a lower end of the cyclone producer 94. A lower end of the accelerator 93 is connected to a hose connection 92. Both the cyclone producer 94 and the accelerator 93 are provided around their outer shoulders with a plurality of inclined through holes 941, 931, respectively, for high pressure air to blow into the cyclon, producer and the accelerator via these inclined holes to produce a cyclone. To assemble the suction gun, first fill the cyclone producer 94 into a main body 91 of the suction gun via a rear end of the gun. Then, hold and screw a barrel 96 of the gun into the cyclone producer 94 via a front opening 913 of the main body 91. Thereafter, the accelerator 93 along with the hose connection 92 are screwed into the main body 91 via a rear opening thereof. Use a suitable tool to clamp against dismounting holes 922 provided on a flange 921 of the hose connection 92 and tightly screw the accelerator 93 to the main body 91. The cyclone producer 94 also has a flange 942 which is pressed against an inner wall of the main body 91. By this way, the accelerator 93 and the cyclone producer 94 are serially connected in the main body 91 to provide a passage for the filament sucked into the gun. Such conventional suction gun may generally meet the requirement of sucking into a filament, it has, however, following drawbacks:

1. The inclined holes provided on the cyclone producer and the accelerator are generally inclinedly drilled straight holes with only poor ability to produce a weak cyclone in the suction gun. Moreover, these inclined holes are not well and effectively planned in their positions, causing a part of the push force produced by the cyclone to offset one another without working on the filament. The force of the cyclone is wasted and only a poor cyclonic effect can be provided.

2. The cyclone producer and the accelerator must be mounted into and dismounted from the suction gun via a rear end of the main body thereof. In case of any failure of the gun due to any jammed filament in the gun, it is necessary to rotate and loosen the hose connection from the main body to clear the jammed. The rotation of the hose connection shall cause the hose behind the connection to wind. Any tool used to rotate the hose connection shall also collide with a ball valve at one side of the main body, making the dismounting more difficult.

3. The cyclone producer and the accelerator together provide a nearly straight passage in the suction gun. In the instant of being sucked into the gun and contacting with the cyclonic air flow, the filament shall follow the cyclone to rotate and frictionally touch the wall of the passage inside the cyclone producer and the accelerator. This causes the filament to move forward at a reduced speed. In a worse condition, the filament breaks and adheres to the passage wall to clog the passage and adversely affect the suction force of the gun.

It is therefore tried by the inventor to develop an improved suction gun to eliminate the above-mentioned drawbacks found in the conventional suction gun.

SUMMARY OF THE INVENTION

A primary object of the present invention is to provide a suction gun which has helical grooves formed on the cyclone producer and the accelerator to produce even stronger cyclonic air flow, so that a filament can be more effectively sucked into and discharged from the suction gun.

Another object of the present invention is to provide a suction gun which allows the cyclone producer and the accelerator to be removed from the gun via a front opening of the gun to facilitate maintenance and removal of jammed filament from the gun.

A further object of the present invention is to provide a suction gun which has specially designed filament passage inside the cyclone producer and the accelerator to avoid possible resistance against the moving filament due to frictional contact of the filament with the passage wall during a suction operation.

A still further object of the present invention is to provide a suction gun which is energy-saving and can therefore provide even higher suction speed with less air flow amount.

A still further object of the present invention is to provide a suction gun which has a continuous cyclone producing chamber, so that no dead corner or clearance will exist in the suction gun after it is assembled. This prevents the filament moving forward in a winding manner at high speed from becoming jammed in the gun to clog and stop operation of the suction gun. This allows the suction gun of the present invention to have a usable life three to four times longer than that of the conventional suction gun.

To achieve the above and other objects of the present invention, there is provided an ultrahigh speed suction gun having separate cyclone producer and accelerator which can be conveniently mounted into or dismounted from the suction gun via a large enough front opening of the suction gun to facilitate repair and maintenance thereof. The cyclone producer or the accelerator is provided with an expanded inner space portion to serve as a turning space for a filament sucked into the suction gun to freely circle therein to reduce possible resistance against the proceeding filament.

In a first embodiment of the present invention, the cyclone producer and the accelerator both have a conic rear end with a plurality of helical grooves formed thereon to produce a stronger accelerated cyclone in the suction gun to suck the filament. In a second embodiment of the present invention, the cyclone producer and the accelerator both have stepped outer walls and accordingly shoulder portions between two stepped surfaces. Sets of inclined through holes of different inclinations decided via computer simulation technique are separately equally spaced on the shoulder portions. These inclined holes cooperate with a conic passage defined by the accelerator to produce air currents which blow along lines tangent to the circling and accelerated filament in the accelerator and create added air speed to push the filament forward. The conic passage and the inclined holes at different levels and with different inclinations allow the air flow being discharged from the suction gun to form an anticyclone in the conic passage to provide a convergence and jet effect as can be found in an aircraft. Thereby, only a small amount of air flow is needed to generate ultrahigh speed cyclone in the suction gun to effectively suck into and discharge a filament. A large amount of energy can therefore be saved.

BRIEF DESCRIPTION OF THE DRAWINGS

The structure and the operation of the present invention can be best understood by referring to the following detailed description of the preferred embodiments and the accompanying drawings, wherein

FIG. 7 is a partially sectional view of the cyclone producer of the second embodiment of the present invention, showing locations of inclined through holes provided thereon;

FIG. 7*a* is an end view of the cyclone producer of the second embodiment of the present invention;

FIG. 8 is a partially sectional view of the accelerator of the second embodiment of the present invention, showing locations of inclined through holes provided thereon;

FIG. 8*a* is an end view of the accelerator of the second embodiment of the present invention;

DETAILED DESCRIPTION OF THE PREFERRED EMBODIMENTS

Figure 1:
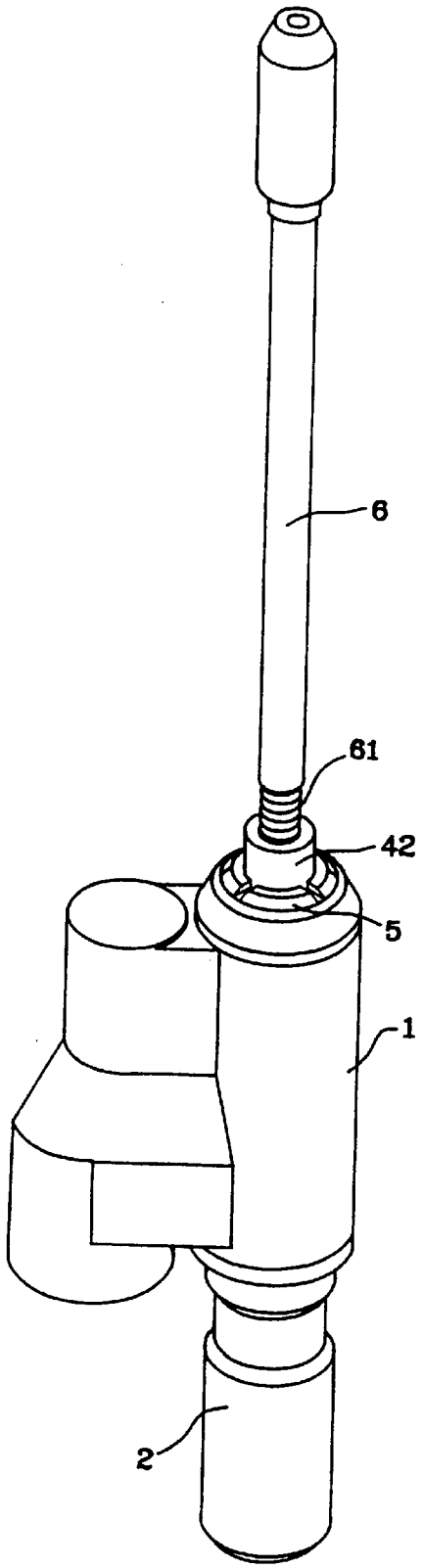
FIG. 1 is an assembled perspective of a first embodiment of the present invention.
Figure 2:
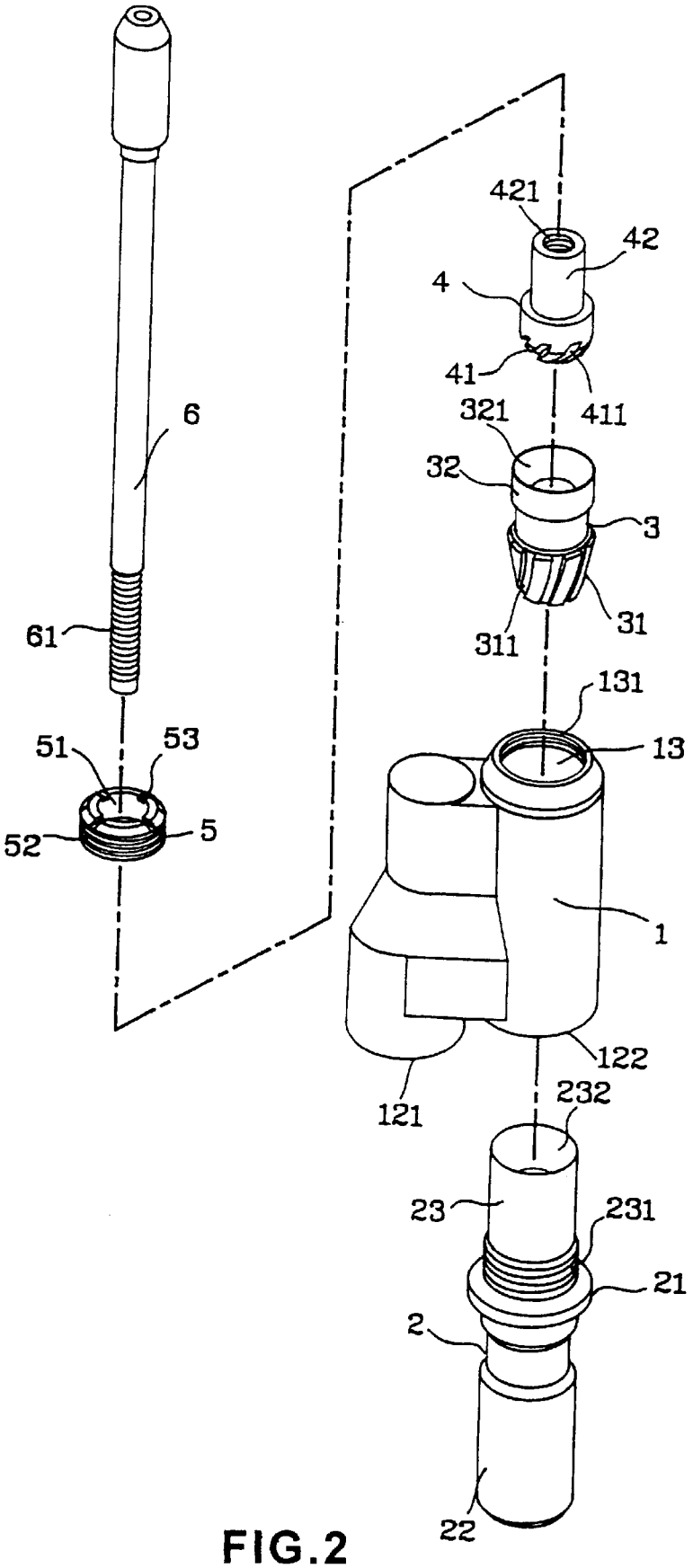
FIG. 2 is an exploded perspective of the first embodiment of the present invention.
Figure 3:
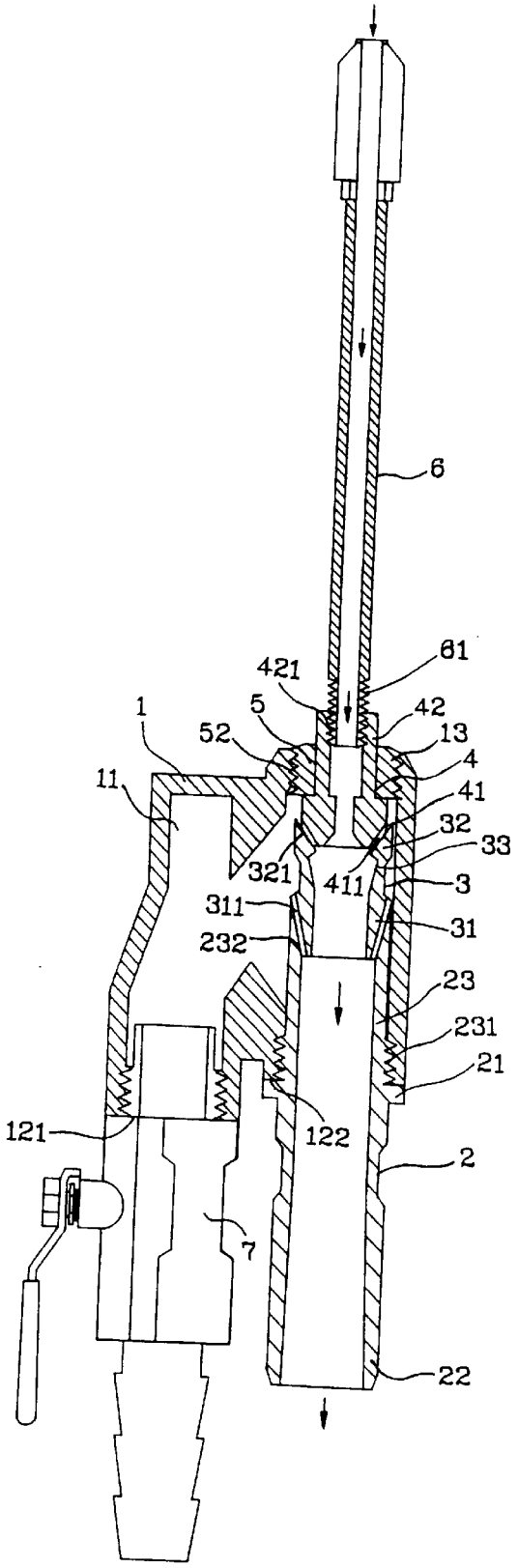
FIG. 3 is an assembled sectional view of the suction gun of FIG. 1.

Please refer to FIGS. 1, 2 and 3 in which an ultrahigh speed suction gun according to a first embodiment of the present invention is shown. As shown, the suction gun mainly includes a main body 1, a hose connection 2, an accelerator 3, a cyclone 4, a fastening member 5, and a barrel 6.

The main body 1 defines a substantially h-shaped inner air circulating space 11. A first rear end of the space 11 is provided with an internally threaded connecting opening 121 for an air valve 7 to connect thereto for serving as an air flow inlet to introduce high pressure air into the main body 1. A second rear end of the space 11 is provided with an internally threaded connecting opening 122 for the hose connection 2 to connect thereto for serving as an air flow outlet to discharge the air. A front opening 13 of the main body 1 is provided with an internal thread 131 for the fastening member 5 to screw thereinto. The front opening 13 has a diameter large enough for the accelerator 3 and the cyclone producer 4 to mount into the main body 1 from the front opening 13.

The hose connection 2 is an elongated tubular member having a collar 21 formed near a middle portion of the member. A portion of the member 2 behind the collar 21, that is, a rear portion of the member 2, forms an outer tube 22 for a hose 8 to connect thereto, and a portion of the member 2 in front of the collar 21, that is, a front portion of the member 2, forms an inner tube 23 with an external thread 231 engagable with the internal thread of the connecting opening 122, allowing the hose connection 2 to fixedly connect to the main body 1 with the inner tube 23 extending into the main body 1. A front end of the member 2 forming an opening 232 of the inner tube 23 has a gradually increased inner diameter for receiving a rear end 31 of the accelerator 3 therein.

The accelerator 3 is a short tubular member defining an inner space having an expanded portion 33 with a substantially < >-shaped vertical section. The rear end 31 of the accelerator 3 has a conic profile with a plurality of helical grooves 311 provided over the conic end surface 31. A front end 32 of the accelerator 3 forms an opening 321 having a gradually increased inner diameter for receiving a rear end 41 of the cyclone producer 4 therein.

The cyclone producer 4 is also a short tubular member having a conic rear end 41. A plurality of helical grooves 411 are provided over the conic end surface 41. A front portion 42 of the cyclone producer 4 is a projected rod with an internally threaded hole 421 for the barrel 6 to screw thereinto.

The fastening member 5 is preferably a pressing ring or a function-equivalent locking member with a threaded external circumferential surface 52 for engaging with the internally threaded front opening 13 of the main body 1. The pressing ring 5 has a central through hole 51 for the front portion 42 of the cyclone producer 4 to extend therethrough. A number of dismounting notches 53 are provided on a front end surface of the pressing ring 5 to facilitate loosening of the ring 5 from the main body 1 with a suitable tool.

The barrel 6 is a slender tubular member with a thread 61 provided around an outer rear end thereof for screwing into the internally threaded hole 421 of the cyclone producer 4.

To assemble the suction gun of the present invention, first fix the air valve 7 and the hose connection 2 to the first connecting opening 121 and the second connecting opening 122 of the main body 1, respectively. Then, sequentially put the accelerator 3 and the cyclone producer 4 into the main body 1 via the front opening 13 of the main body 1. Align the central through hole 51 of the fastening member 5 with the front projected rod 42 of the cyclone producer 4 so as to put the fastening member 5 around the projected rod 42. Use a suitable tool to rotate the fastening member 5 so that its thread 52 engages with the internally threaded opening 13 of the main body 1. Keep rotating the member 5 until it presses against the rear conic end 41 of the cyclone producer 4. At this point, the projected rod 42 of the cyclone producer 4 projects from the main body 1 to engage with the barrel 6.

The assembling of the suction gun of the present invention is convenient and any troubleshooting may be directly done via a front end of the suction gun.

Figure 4:
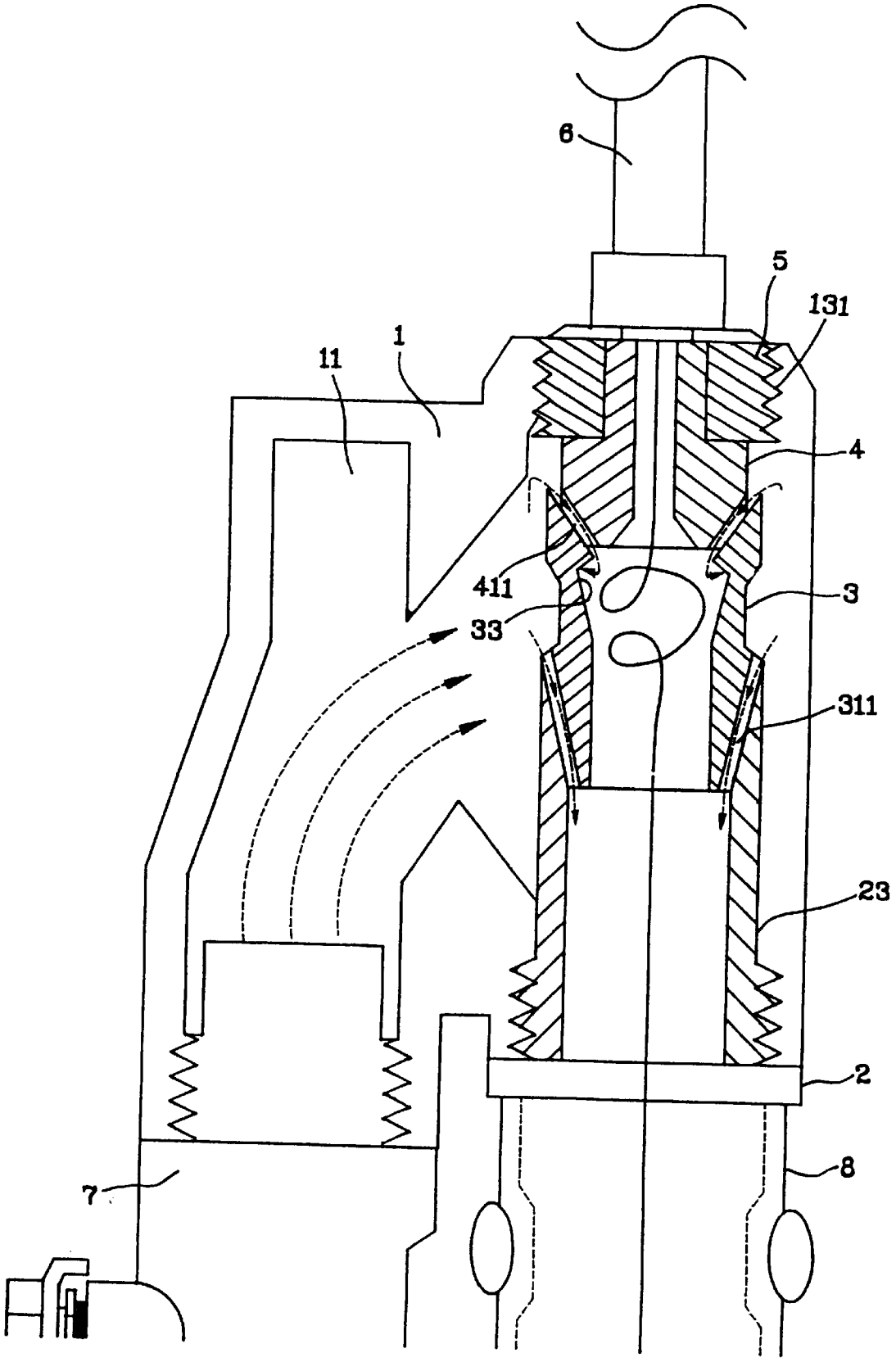
FIG. 4 is an enlarged fragmentary sectional view of the suction gun of FIG. 1, showing the manner in which the cyclone is created in the suction gun and the filament is sucked to pass through the gun.

Please now refer to FIGS. 3 and 4. The accelerator 3 and the cyclone producer 4 are fixedly held between the hose connection 2 and the fastening member 5 after the whole suction gun is assembled. Wherein, the rear conic end 31 of the accelerator 3 is seated in the internally expanded opening 232 of the inner tube 23 of the hose connection 2 and the rear conic end 41 of the cyclone producer 4 is seated in the internally expanded opening 321 of the accelerator 3, so that a continuous passage is formed inside the cyclone producer 4 and the accelerator 3.

To use the suction gun, high pressure air is introduced into the main body 1 via the first rear connecting opening 121. The introduced air circulates in the main body 1 and forms a cyclonic and accelerated flow when it passes through the cyclone producer 4 and the accelerator 3. The air is then guided to flow out of the main body 1 via the hose connection 2 connected to the second rear connecting opening 122 of the main body 1. This allows the barrel 6 to always maintain an vacuumized condition and guides a filament sucked into the barrel 6 via a front opening thereof to pass the passage defined by the cyclone producer and the accelerator and be sent toward a rear end of the suction gun.

As mentioned before, there are helical grooves 311, 411 provided over the conic end surfaces of the accelerator 3 and the cyclone producer 4, respectively. The accelerator 3 has longer conic end surface 31 than the cyclone producer 4 and therefore has longer helical grooves 311 which have smaller inclination and turning angle than that of the helical grooves 411 of the cyclone producer 4 to provide an enhanced acceleration effect. When the high pressure air flows through the accelerator 3, a cyclone and acceleration effect are much better than can be provided by a conventional suction gun. Moreover, the < >-shaped expanded portion 33 in the accelerator 3 provides a turning space for the filament when it passes through the vacuumized barrel 6 of the suction gun and circles in the accelerator 3 due to the cyclone produced by the cyclone producer 4. With the turning space in the accelerator 3, the filament would not touch the inner wall of the accelerator 3 to reduce its moving speed. The trouble of jammed filament in the suction gun can therefore be effectively prevented to reduce failure of the suction gun.

Figure 5:
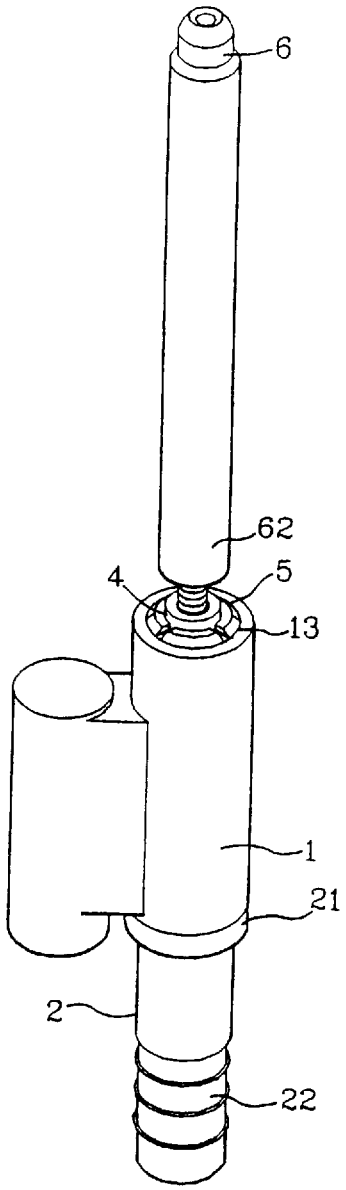
FIG. 5 is an assembled perspective of a second embodiment of the present invention.
Figure 6:
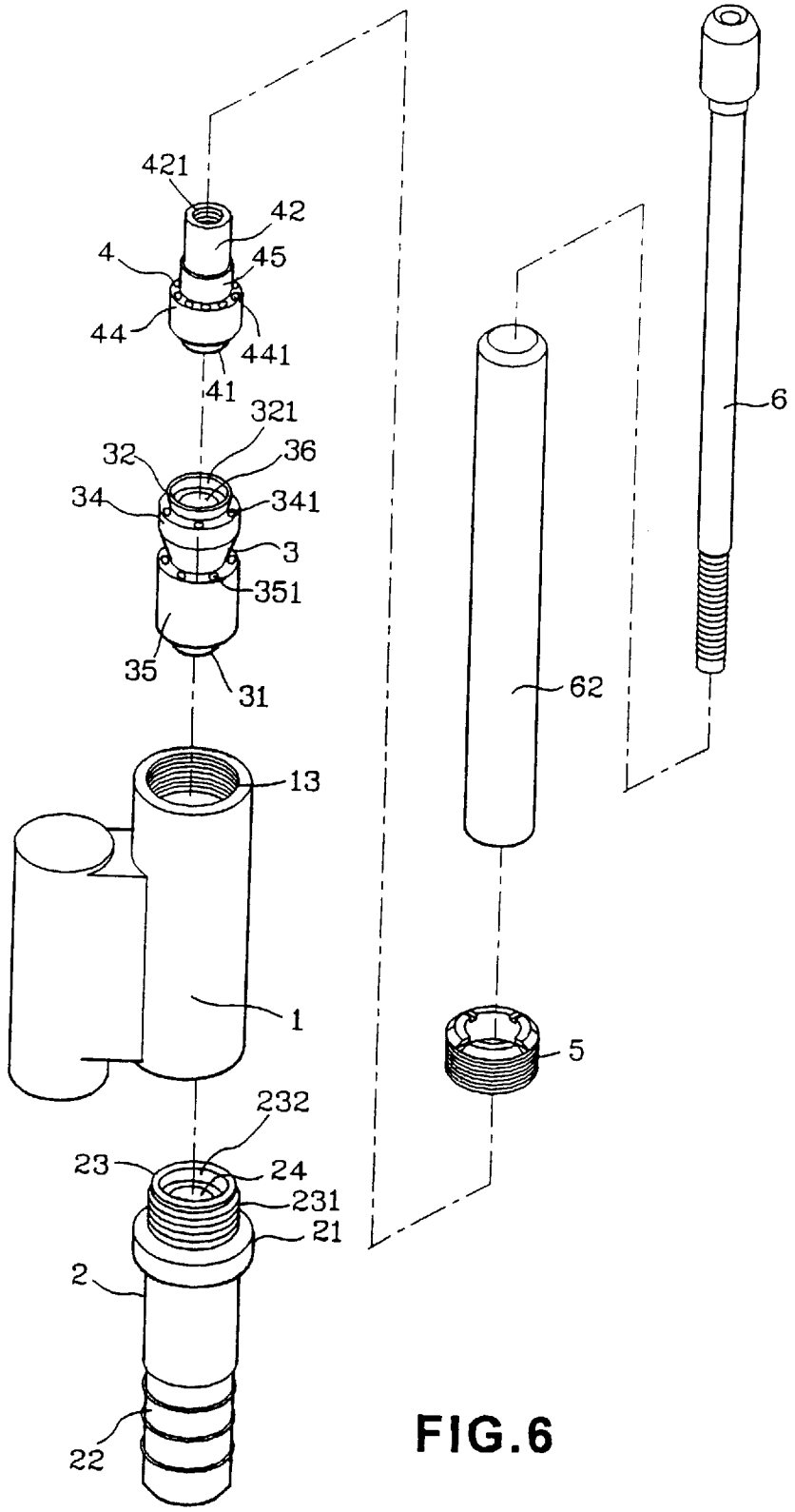
FIG. 6 is an exploded perspective of the second embodiment of the present invention.

FIGS. 5 and 6 illustrate an ultrahigh speed suction gun according to a second embodiment of the present invention. The suction gun in this second embodiment has a structure generally similar to that of the suction gun in the first embodiment with following changes:

The cyclone producer 4 is a stepped tubular member having different external diameters. A front portion 42 of the cyclone producer 4 is a projected rod for the barrel 6 to screw thereinto. A protective shell 62 may be put over the barrel 6 to prevent the barrel from accidentally colliding with and damaging a smooth roller when the barrel guides a filament to pass the roller rotating at high speed. A middle stepped portion 44 of the cyclone producer 4 is provided on and around its shoulder with a plurality of equally spaced inclined through holes 441. A collar 45 is formed between the front projected rod 42 and the middle stepped portion 44. The cyclone producer 4 in this second embodiment has an expanded inner space portion 43 in the middle stepped portion 44, as shown in FIG. 7. A rear end 41 of the cyclone producer 4 forms a coupling sleeve to connect with the accelerator 3.

The accelerator 3 in this second embodiment is also a stepped tubular member having different diameters. A front end portion 32 of the accelerator 3 defines an expanded opening 321 for receiving the rear end 41 of the cyclone producer 4 therein. A middle portion of the accelerator 3 includes two stepped portions 34 and 35. A plurality of inclined through holes 341, 351 are equally spaced along shoulder portions of the two stepped portions 34, 35, respectively. The through holes 341 and 351 have different inclinations. The front end 32 has a downward and inward inclined outer wall and the middle portion 34 also has a downward and inward inclined lower wall. These inclined walls facilitate convenient entrance of air flow into the accelerator 3. The accelerator 3 defines a slightly conic passage 36 therein. A rear end 31 of the accelerator 3 also forms a coupling sleeve.

The hose connection 2 in this second embodiment is a long tubular member with a collar 21 of larger diameter formed around and near a middle portion of the member 2. A portion of the hose connection 2 behind the collar 21 is an outer tube 22 for a hose 8 to connect thereto, and a portion of the hose connection 2 in front of the collar 21 is an inner tube 3 for extending to the main body 1. A front end of the inner tube 23 defines an expanded opening 232 for receiving the rear end 31 of the accelerator 3. The hose connection 2 defines a slightly conic passage 24 therein.

Please refer to FIGS. 6, 7 and 8 at the same time. In this second embodiment, computer simulation technique and virtual operations are employed to find how the filament will rotate while it moves forward in the passages 36, 24 under an accelerated cyclone produced by the cyclone producer 4 and the accelerator 3 through inclined through holes 341, 351, and 441 respectively in different inclinations. Experiments indicate the best positions for the air inlets and outlets of the inclined holes at three different levels are those allowing air entering the passages 36, 24 via the inclined holes 441, 341, and 351 to blow along lines tangent to the filament accelerating and circling in the passages 36, 24.

Figure 9:
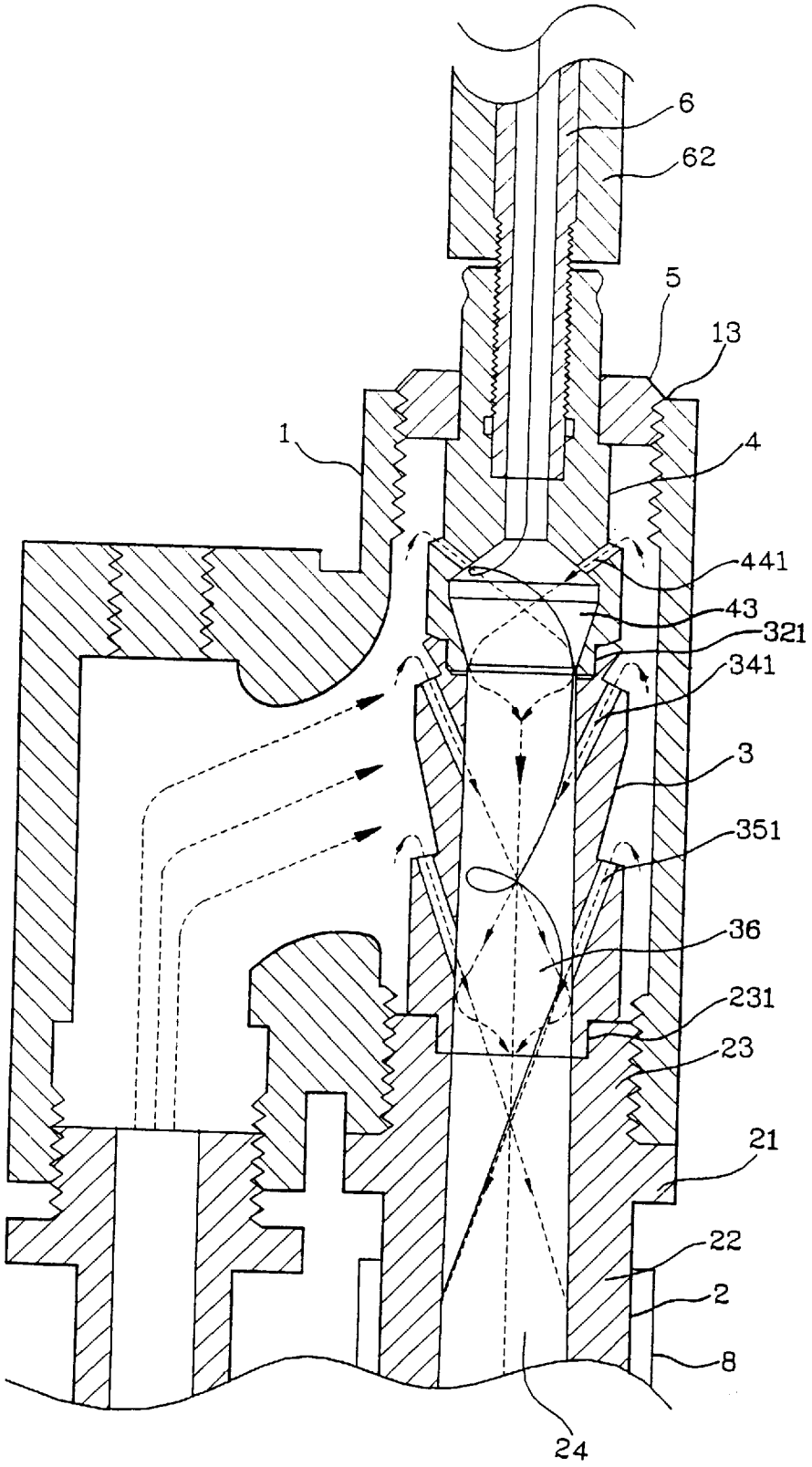
FIG. 9 is an enlarged fragmentary sectional view of the suction gun of FIG. 5, showing the manner in which the cyclone is created in the suction gun and the filament is sucked to pass through the gun.
Figure 10:
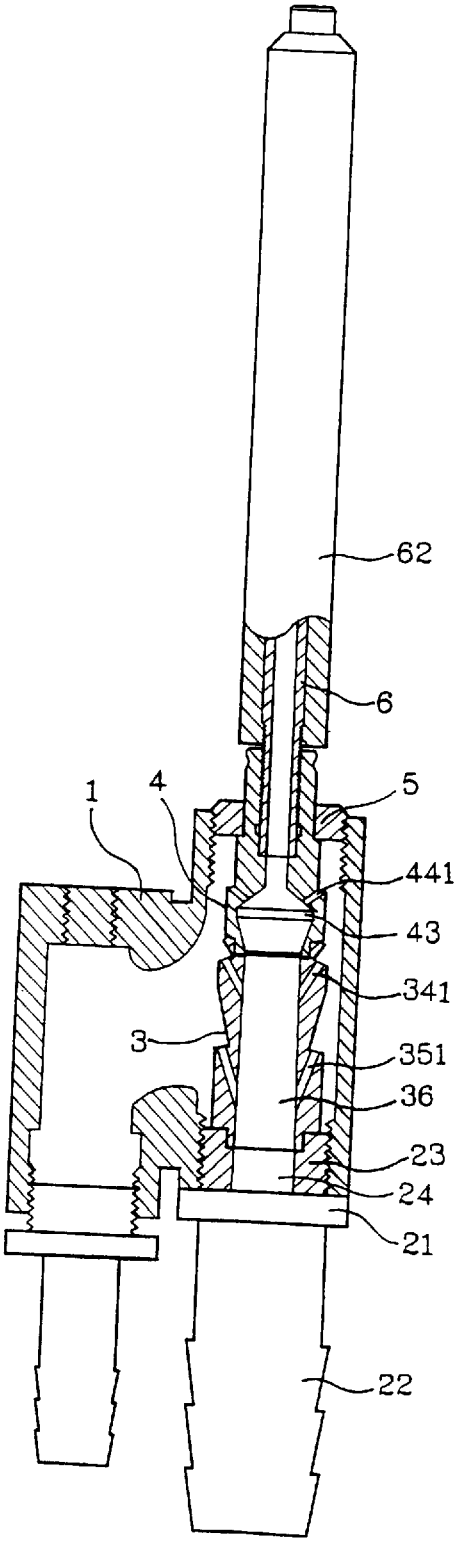
FIG. 10 is an assembled sectional view of the second embodiment of the present invention.
Figure 11:
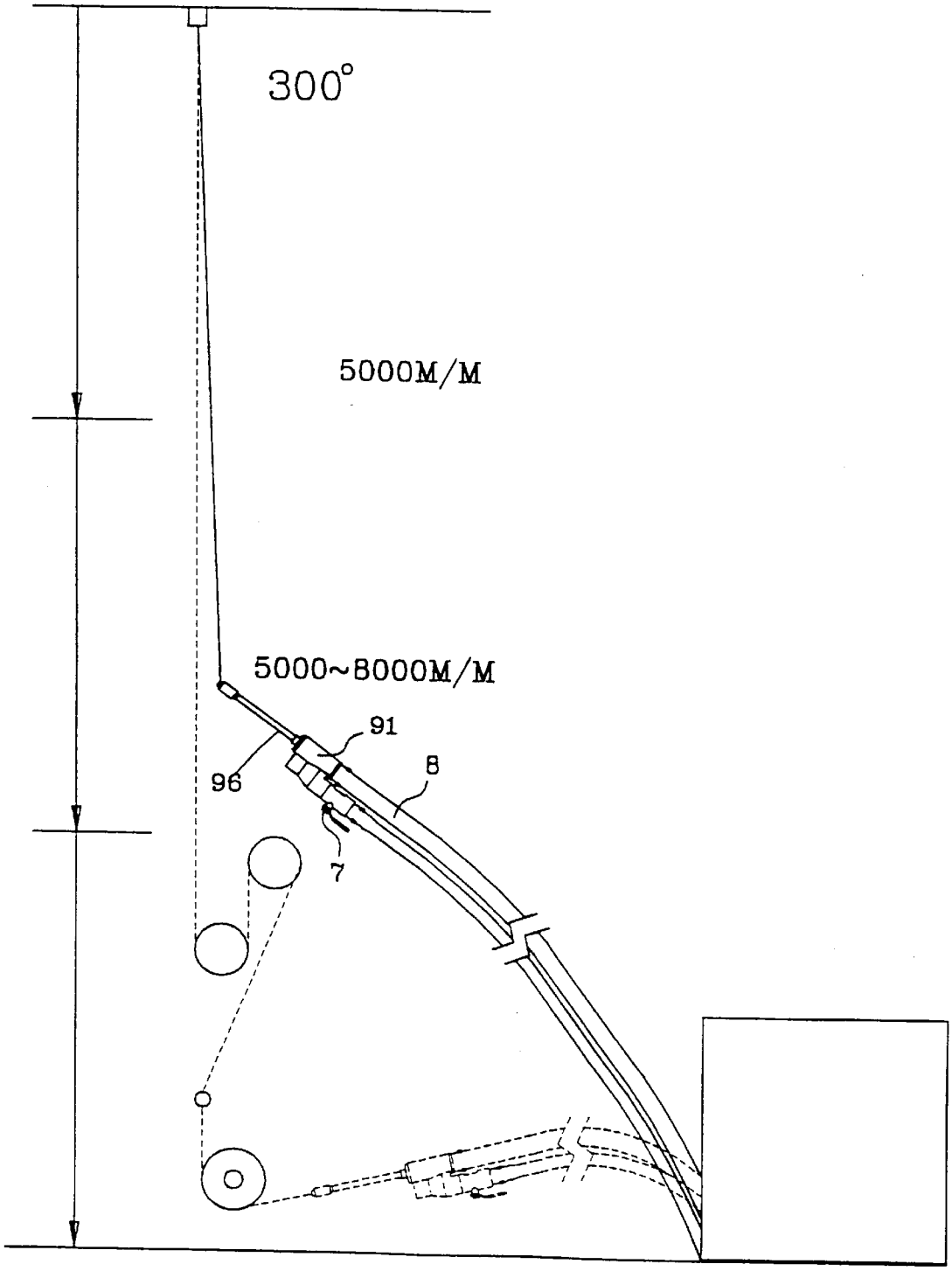
FIG.11 PRIOR ART
FIG. 11 schematically illustrates the manner in which a suction gun is employed in the processing of a filament.
Figure 12:
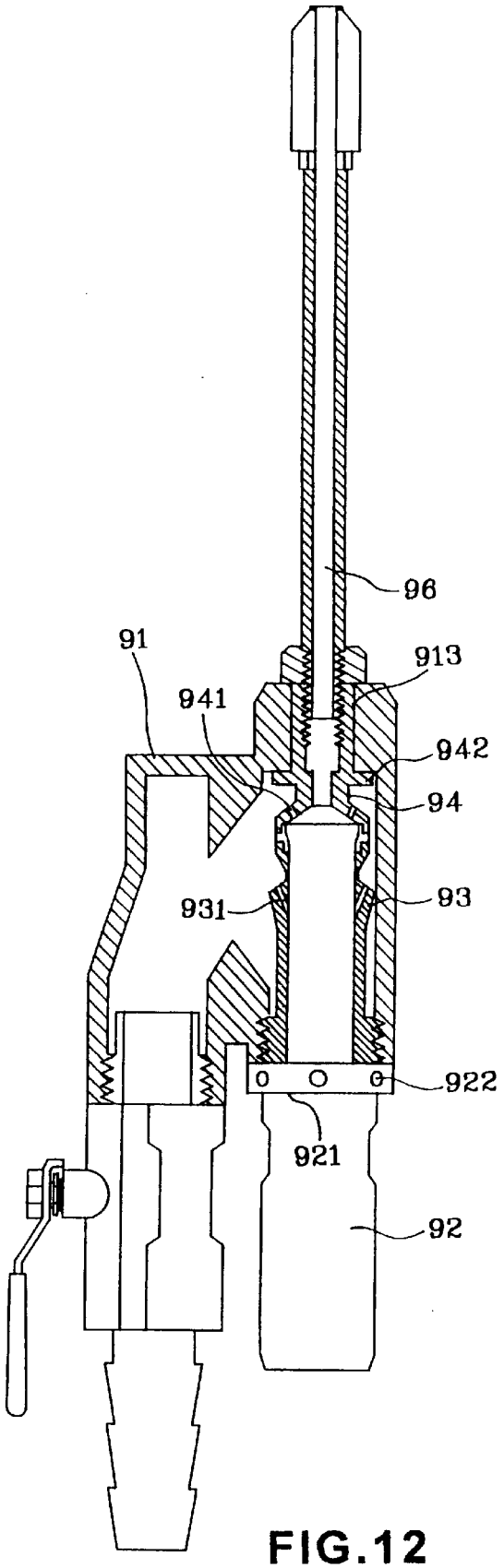
FIG. 12 is an assembled sectional view of a conventional suction gun.

As shown in FIGS. 9 and 10, the accelerator 3 and the cyclone producer 4 in the second embodiment may also be conveniently mounted into the main body 1 via the front opening 13 as in the first embodiment. Any troubleshooting may also be done easily to remove jammed filament from the suction gun.

After the whole suction gun is assembled, the accelerator 3 and the cyclone producer 4 are fixedly held between the hose connection 2 and the fastening member 5. With the inclined holes 441, 341, and 351 separately provided on the cyclone producer 4 and the accelerator 3 at three different levels as decided via computer simulation, as well as with the expanded inner space 43 in the cyclone producer 4, the filament sucked into the cyclone producer 4 shall initially circle about the expanded inner space 43 under air flow blowing into the cyclone producer 4 via the inclined holes 441 on the cyclone producer 4. Thereafter, when the filament moves to a position which provides reduced push force to the filament, the air flow blowing into the passage 36 via the inclined holes 341 on a higher position of the accelerator 3 shall accelerate the filament again. When the filament moves to another position providing reduced push force, the air flow blowing into the passages 36 and 24 via the inclined holes 351 on a lower position of the accelerator 3 shall accelerate the filament again. In brief, the filament passing through the conic passages 36 and 24 will be pushed to move forward and finally be discharged from the suction gun under three different cyclonic air flows all moving at very high speed.

From FIG. 9, it can be clearly seen that air flows blowing into the passages 36, 24 via the inclined holes 441, 341, and 351 move along lines tangent to the circling and accelerating filament. This will allow the cyclonic air flows to have added blowing speed without offsetting one another. In a completely assembled suction gun, the passage 36 defined by the accelerator 3 and the passage 24 defined by the hose connection 2 together provide a slightly conic continuous passage in the suction gun. This continuous conic passage cooperates with the inclined holes 441, 341, 351 located at three different levels to allow the air flow flowing toward the air outlet of the suction gun to generate an anticyclone which converges the three air flows' pressure and produces a jet effect as can be found in an aircraft. This is a characteristic and key point of success of the present invention. With this design, only a small air to flow is needed to produce multiplied push force to effectively suck and discharge the filament at very high speed. A large amount of energy can therefore be saved.

What is to be noted is the form of the present invention shown and disclosed is to be taken as a preferred embodiment of the invention and that various changes in the shape, size, and arrangements of parts may be resorted to without departing from the spirit of the invention or the scope of the subjoined claims.

What is claimed is:

1. An ultrahigh speed suction gun, comprising a main body, a hose connection, an accelerator, a cyclone producer, a barrel, and a fastening member;

said main body defining a generally h-shaped inner space having a first rear opening, a second rear opening, and a front opening, said first rear opening of said main body having an air valve connected thereto for serving as a high pressure air flow inlet, said second rear opening of said main body having said hose connection connected thereto for serving as an air flow outlet, said front opening of said main body having an inner diameter large enough for said accelerator and said cyclone producer to mount into said main body via said front opening;

said hose connection being a long tubular member having a collar formed near and around a middle portion thereof, a part of said hose connection in front of said collar being an inner tube portion of said hose connection for extending into and engaging with said second rear opening of said main body, a part of said hose connection behind said collar being an outer tube portion of said hose connection for projecting from said main body to connect a hose;

said accelerator being a short tubular member mounted in said main body with a rear end thereof seated in a front opening of said inner tube of said hose connection;

said cyclone producer being a short tubular member mounted in said main body with a rear end thereof seated in a front opening of said accelerator, a front end of said cyclone producer being an internally threaded projected rod for said barrel of said suction gun to screw thereinto; and said fastening member being screwed into said front opening of said main body to fixedly hold said cyclone producer and said accelerator between said fastening member and said hose connection, said fastening member having a central through hole for said projected rod of said cyclone producer to extend therethrough and project from said front opening of said main body for receiving said barrel;

whereby a high pressure air flow can be introduced into said main body from said air valve connected to said first rear opening of said main body to circulate in said main body, said air flow blowing into said cyclone producer and said accelerator and forming cyclonic air flows which move forward at very high speed before flowing out of said hose connection, said accelerated cyclonic air flows vacuumizing said barrel, causing a filament to be sucked into said suction gun via said barrel and then be guided through said cyclone producer and said accelerator to said second rear opening of said main body via said hose connection, and whereby said cyclone producer and said accelerator can be conveniently dismounted from said main body via said front opening of said main body to remove any jammed filament in said suction gun.

2. An ultrahigh speed suction gun as claimed in claim 1, wherein said accelerator has a conic rear end with a plurality of helical grooves formed over a conic surface of said rear end, and an outward expanded front opening for receiving said rear end of said cyclone producer; wherein said cyclone producer has a conic rear end with a plurality of helical grooves formed over a conic surface of said rear end; and wherein said inner tube of said hose connection has an outward expanded front opening for receiving said conic rear end of said accelerator, whereby stronger and accelerate d cyclonic air flows can be produced.

3. An ultrahigh speed suction gun as claimed in claim 2, wherein said rear conic surface of said accelerator is longer that of said cyclone producer, and said helical grooves of said accelerator are longer and slant less than that of said cyclone producer, and wherein said accelerator defines a < >-shaped expanded inner space to provide a turning space in said accelerator for said filament to pass said accelerator without increased resistance.

4. An ultrahigh speed suction gun as claimed in claim 1, wherein said front opening of said main body is internally threaded, and wherein said fastening member is a pressing ring with a thread provided around an outer circumferential surface thereof for engaging with said internally threaded front opening of said main body and to pressing against said cyclone producer, and said fastening member having a number of dismounting notches provided on a end surface thereof to facilitate mounting and dismounting of said fastening member into and from said main body.

5. An ultrahigh speed suction gun as claimed in claim 1, wherein said cyclone producer is a stepped tubular member having at least a front coupling sleeve portion, a middle expanded portion, and a rear coupling sleeve portion; said middle expanded portion having a plurality of inclined through holes equally spaced on a shoulder portion of said middle portion; wherein said accelerator is also a stepped tubular member defining a slightly conic passage therein and having at least a front end defining an expanded front opening for receiving said rear coupling sleeve portion of said cyclone producer, a first middle portion and a second middle portion separately having a downward and outward inclined shoulder portion, and a rear coupling sleeve portion, said first and said second middle portions having a plurality of inclined through holes equally spaced on their respective shoulder portion, said inclined through holes on said first middle portion having an inclination different from that of said inclined through holes on said second middle portion; and wherein said hose connection defines a slightly conic passage and has an expanded front opening for receiving said rear coupling sleeve portion of said accelerator; whereby said conic passages defined by said accelerator and said hose connection cooperate with said inclined holes on said cyclone producer and said accelerator to allow said air flows blowing toward said air outlet of the main body to generate an anticyclone which converges all air flows' pressure and produces a jet effect in said conic passages, so that only a small source air flow is needed to generate highly accelerated cyclonic air flows in said suction gun to effectively suck in and discharge a filament.

6. An ultrahigh speed suction gun as claimed in claim 5, wherein said inclined through holes on said cyclone producer and said accelerator are located at three different levels in the main body with their air flow inlets and air flow outlets decided by computer simulation technique, such that air blowing into said cyclone producer and said accelerator via said inclined holes at three different levels forms cyclonic air flows which all move along lines respectively tangent to the moving directions of said filament circling under said accelerated cyclonic air flows, whereby all said cyclonic air flows together provide an added speed without offsetting one another and said filament entering into said conic passages defined by said accelerator and said hose connection can be discharged from said suction gun under three accelerated cyclonic air flows.

7. An ultrahigh speed suction gun a, claimed in claim 5, wherein said stepped tubular cyclone has different outer diameters, a collar provided between said front coupling sleeve portion and said middle expanded portion, and an expanded inner space portion formed in said middle portion; and wherein said front end portion and said first middle portion of said stepped tubular accelerator both have a downward and inward inclined outer wall surface respectively facing said shoulder portions on said first and said second middle portions of said accelerator.

8. An ultrahigh speed suction gun as claimed in claim 1, wherein said barrel is covered with a protective shell to prevent said barrel from accidentally colliding with and damaging a smooth surface of a roller which rotates at high speech when said suction gun is used to guide a filament to wind through said roller.

* * * * *